United States Patent [19]

Dolan et al.

[11] Patent Number: 4,732,007

[45] Date of Patent: Mar. 22, 1988

[54] AUXILIARY THERMAL INTERFACE TO COOLING/HEATING SYSTEMS

[75] Inventors: William H. Dolan, Mount Prospect; William D. Ingle, III, Park Ridge, both of Ill.

[73] Assignee: Gas Research Institute, Chicago, Ill.

[21] Appl. No.: 946,429

[22] Filed: Dec. 23, 1986

[51] Int. Cl.[4] ..... F25B 7/00

[52] U.S. Cl. ..... 62/79; 62/238.6

[58] Field of Search ..... 62/79, 117, 425, 426, 62/424, 513, 238.6, 238.7, 198, 199

[56] References Cited

U.S. PATENT DOCUMENTS

| | | | |
|---|---|---|---|
| 4,049,045 | 9/1977 | Moog et al. | 165/12 |
| 4,098,092 | 7/1978 | Singh | 62/238.6 |
| 4,179,894 | 12/1979 | Hughes | 62/160 X |
| 4,199,955 | 4/1929 | Jonsson | 62/79 |
| 4,251,996 | 2/1981 | Esformes et al. | 62/79 |
| 4,259,848 | 4/1981 | Voigt | 62/513 X |
| 4,281,519 | 8/1981 | Spath et al. | 62/79 |
| 4,373,346 | 2/1983 | Hebert et al. | 62/79 |
| 4,493,193 | 1/1985 | Fisher | 62/238.7 X |

*Primary Examiner*—Lloyd L. King

*Attorney, Agent, or Firm* -Thomas W. Speckman; Ann W. Speckman

[57] ABSTRACT

Utilizes an auxiliary chilled/heated medium to provide cooling/heating by interface to a compressor-based refrigerant cycle. Utilizes remotely obtained chilled or warmed thermal exchange media while enabling easy retrofitting and providing greater operating flexibility to compressor-based refrigerant systems.

18 Claims, 4 Drawing Figures

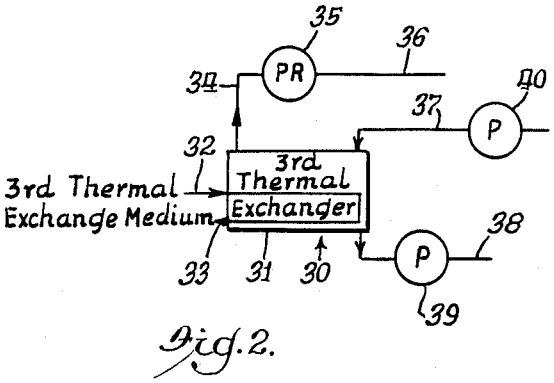
Fig. 2.
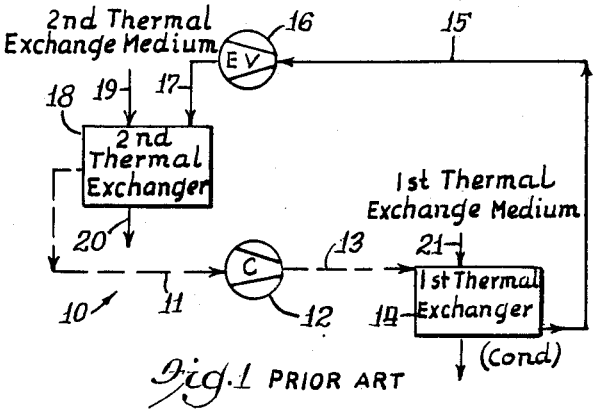
Fig. 1 PRIOR ART
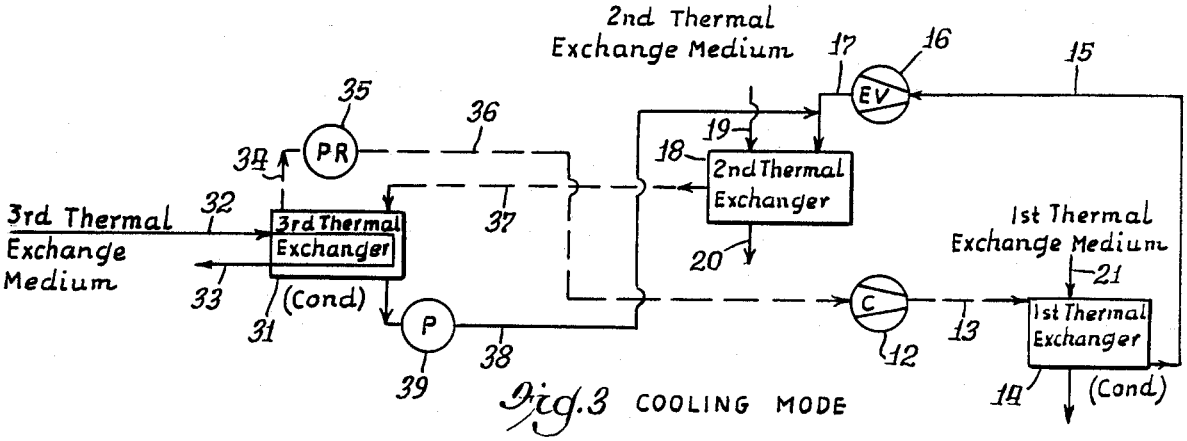
Fig. 3 COOLING MODE
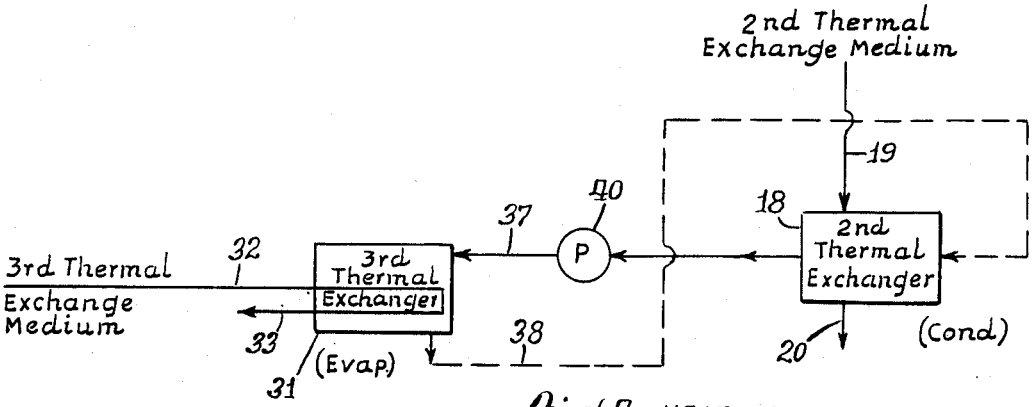
Fig. 4. HEATING MODE

AUXILIARY THERMAL INTERFACE TO COOLING/HEATING SYSTEMS

BACKGROUND OF THE INVENTION

1. Field of the Invention

This invention relates to use of auxiliary chilled/-heated medium, such as water, to produce cooling-/heating by interface to a compressor-based refrigerant cycle, such as direct expansion air conditioning. The invention is especially suitable for retrofit to standard direct expansion air conditioning packages, providing the additional feature of utilizing the package evaporator coil for tempering air. Interface of the auxiliary chilled/heated medium may be achieved by a refrigerant-to-water heat exchanger, for example, to transfer thermal energy from a tempered water source to drive a refrigerant phase change and utilizing the thermal energy of the refrigerant phase change in a direct expansion evaporator of a compressor based refrigerant cycle. The thermal energy withdrawal or addition by the auxiliary medium may be utilized in all compressor based refrigerant cycles and may be in place of or in addition to the cooling produced by the compressor-based refrigerant cycle. This invention is applicable to refrigeration and cooling/heating air conditioning applications.

2. Description of the Prior Art

Unitary HVAC systems, sometimes referred to as rooftop, or roof mounted units, are presently commonly used space conditioning systems for commercial facilities. The unitary HVAC systems generally have a single loop refrigerant cycle wherein refrigerant vapor is compressed, the compressed refrigerant vapor is condensed in an ambient air cooled condenser, the liquid refrigerant is passed through an expansion device, and then passed through a direct expansion cooling coil producing a cooling effect to air passing that coil. Present unitary HVAC systems are almost exclusively electrically driven, having electric motor driven compressors. Thermal transfer such as cooling from auxiliary or alternate sources, such as heat-actuated absorption cooling, or alternate cooling or heating sources utilizing thermal energy from natural gas, cogeneration, and the like, has not typically been commercially interfaced with compressor based refrigerant systems because prior proposals have required complex and extensive modification to the compressor based refrigerant systems making the cost extremely high.

Integrated heat exchange systems are taught by U.S. Pat. No. 4,098,092 wherein a heating/cooling heat pump type system is interconnected with an auxiliary water heater wherein thermal energy is recovered from the refrigeration loop to preheat water being fed to a water heater. U.S. Pat. No. 4,199,955 teaches installation of a supplemental hot water heat exchanger between the compressor and condenser of a conventional compressor and condenser of an air conditioning and refrigeration system to utilize the thermal energy of the refrigerant gas thereby improving the overall efficiency of the host air conditioning system. Staged thermal energy recuperation systems are taught by U.S. Pat. No. 4,049,045 wherein the heating and cooling system has thermal storage reservoirs for recuperated thermal energy in each circuit, and U.S. Pat. No. 4,373,346 teaching regulation of water flow so that the refrigerant is precooled to its saturated-vapor state and sub-cooled in the cooling mode and post-heated to at least a saturated-vapor state and sub-cooled when the system is in the heating mode. This is achieved by a separate water loop in sequence through a ground grid heat exchanger/sub-cooler/pre-cooler/condenser in association with the refrigerant cycle. Cooling is taught to be obtained by ambient ground water which cools the system water to approximately 72° F. for introduction to the sub-cooler and the water leaving the sub-cooler at a temperature of about 105° F. to feed the pre-cooler. U.S. Pat. No. 4,179,894 teaches a dual source heat pump system which, in either the heating or cooling mode of operation, will select, for example, either water or air to most efficiently supply the heating or cooling requirements depending upon the relative temperatures of the ambient sources. U.S. Pat. No. 4,281,519 teaches a thermal transfer system which transfers heat energy from a refrigeration loop to a water heating system.

SUMMARY OF THE INVENTION

This invention provides a process and apparatus for interfacing auxiliary chilled/heated medium with a compressor based refrigerant cycle and apparatus. Refrigerant cycles generally have a closed loop wherein refrigerant vapor is compressed, the compressed refrigerant vapor is liquefied in a first thermal exchanger functioning as a condenser in thermal exchange relation to a first thermal exchange medium which is warmed by the thermal exchange, the liquid refrigerant passed through a throttling device, and then passed through a second thermal exchanger in thermal exchange relation to a second thermal exchange medium vaporizing refrigerant for recycle while producing a cooling effect to the second thermal exchange medium passing the second thermal exchanger. This process provides thermal and mass transfer interface of a third thermal exchange medium to the refrigerant cycle at a specific location providing new system operating modes in a simple manner. The interface of the third thermal exchange medium in the manner of this invention provides efficient utilization of alternative thermal sources, both chilled media or heated media which may be obtained from direct firing, heat pipe, waste heat, cogeneration sources, thermal storage systems, and the like, as well as providing operating flexibility.

This invention is applicable to systems in which the first, second, and third thermal exchange media may be liquid or gaseous. This invention is also applicable to multi-loop compressor based refrigerant systems utilizing multiple compressors and/or condensers and evaporators and the following detailed description should not be considered to limit the invention due to the detailed description of a single refrigerant loop compressor based refrigerant system for purposes of explanation.

This invention modifies the path of the refrigerant passing from the second thermal exchanger to pass through a third thermal exchanger in thermal exchange relation to a third thermal exchange medium which provides an auxiliary or alternate source thermal energy exchange, take up or rejection, to the refrigerant. Refrigerant is passed from the third thermal exchanger back to the second thermal exchanger. In the cooling mode, refrigerant vapor may be passed from the third thermal exchanger to the compressor for passage through the first thermal exchanger, throttle, and returned to the second thermal exchanger of the compressor based refrigerant system. In the heating mode the compressor, first thermal exchanger, and throttle are deactivated and refrigerant vapor is passed from the third thermal exchanger to the second thermal exchanger. Thus, a standard compressor based refrigerant apparatus may be readily adapted to this invention by addition of a package comprising a third thermal exchanger with pipe, valving and control systems to control refrigerant flows as described above. The added package may be simply retrofitted to existing compressor based refrigerant apparatus by provision of piping and control connections.

In the cooling mode, the process of this invention retains the compressor based refrigerant cycle fully operational except for passing refrigerant vapor from the second thermal exchanger (evaporator) to a third thermal exchanger (condenser) in thermal exchange relation to a chilled third thermal exchange medium condensing all or a portion of the refrigerant. It is preferable a substantial portion of the refrigerant be condensed in the third thermal exchanger. The third thermal exchange medium is introduced to the third thermal exchanger at a temperature at least about 10° F. below the temperature of the second thermal exchange medium after passing the second thermal exchanger (evaporator) and preferably below about 55° F., most preferably about 40° to about 45° F., causing cooling and condensing of at least a substantial portion of the refrigerant vapor to refrigerant liquid. The condensed refrigerant liquid is passed to the second thermal exchanger (evaporator) of the compressor based refrigerant cycle. Refrigerant vapor remaining after passage through the third thermal exchanger (condenser) is passed to the compressor of the refrigerant cycle and suitably compressed for passage through the first thermal exchanger (condenser) of the compressor based refrigerant cycle where it is condensed as a liquid and passed through throttle means to the second thermal exchanger (evaporator) of the compressor based refrigerant cycle. This provides a two loop system which can readily accommodate any fluctuation or failure of supply of the alternate, interfaced third thermal exchange medium. The liquid refrigerant is passed through the second thermal exchanger (evaporator) of the compressor based refrigerant cycle in heat exchange relation to the second thermal exchange medium causing evaporation of the refrigerant liquid to refrigerant vapor and cooling of the second thermal exchange medium. The second thermal exchange medium is the treatment stream in both cooling and heating modes of operation.

In the heating mode, the process of this invention utilizes the liquid/vapor phase change of refrigerant by passing refrigerant liquid from the second thermal exchanger (condenser) of the compressor based refrigerant cycle to the third thermal exchanger in heat exchange relation to a warmed thermal exchange medium provided at a sufficiently high temperature to cause evaporation of the refrigerant liquid to refrigerant vapor. The refrigerant vapor is then returned to the second thermal exchanger (condenser) where it heats the second thermal exchange medium or treatment stream. The remainder of the compressor based refrigerant apparatus, the compressor, first thermal exchanger, and throttle, is disabled during operation in the heating mode.

It is an object of this invention to provide an apparatus and process for utilization of the remotely obtained chilled or warmed thermal exchange media in conjunction with a conventional compressor based refrigerant cycle.

It is a further object of this invention to provide an apparatus and process enabling easy retrofitting to a conventional compressor based refrigerant system of components necessary to interface chilled or warmed thermal exchange media obtained from alternative sources with a refrigerant in cooling and heating, respectively.

It is another object of this invention to provide an apparatus and process which provides higher operating flexibility of compressor based refrigerant systems.

BRIEF DESCRIPTION OF THE DRAWING

These and other objects and advantages of this invention will become apparent from the following description taken in conjunction with the accompanying drawings showing preferred embodiments wherein:

FIG. 1 is a simplified schematic diagram of a conventional compressor based refrigerant system (Prior Art);

FIG. 2 is a simplified schematic diagram of a third thermal exchanger package for combination with a compressor based refrigerant system;

FIG. 3 is a simplified schematic diagram of a system of this invention in the cooling mode; and FIG. 4 is a simplified schematic diagram of a system of this invention in the heating mode.

DESCRIPTION OF THE PREFERRED EMBODIMENTS

FIG. 1 shows a typical prior art compressor based refrigerant (HVAC) system 10 having a second thermal exchanger 18 such as a direct expansion heat exchanger functioning as a refrigerant evaporator providing cooling to second thermal exchange medium passed over it represented by room airstream 19 and conditioned airstream 20. The second thermal exchanger may be of any suitable type known to the art such as "direct expansion" having both liquid and vapor phases present or "flooded" having substantial liquid phase present and may have direct or indirect thermal exchange relation to the second thermal exchange medium. The refrigerant liquid fed to second thermal exchanger 18 may be vaporized within the second thermal exchanger 18 functioning as an evaporator and passes through refrigerant vapor conduit 11 to refrigerant vapor compressor 12 wherein it is compressed to a suitable pressure for passage through refrigerant vapor conduit 13 to first thermal exchanger 14 functioning as a refrigerant condenser and cooled by first thermal exchange medium such as ambient airstream 21. The refrigerant liquid is then passed from condenser 14 by conduit 15 to any suitable throttling means 16 and then by refrigerant liquid conduit 17 to second thermal exchanger 18 functioning as a refrigerant evaporator.

The package 30 added by this invention is shown schematically in FIG. 2. Third thermal exchange medium such as chilled liquid, may be supplied through conduit 32 and passes through third thermal exchanger 31 in heat exchange relation with refrigerant. The third thermal exchange medium may be discharged through discharge conduit 33. Refrigerant may be supplied through conduit 37 from the second thermal exchanger 18 of the compressor based refrigerant system, as shown in FIG. 1. The refrigerant is supplied through refrigerant supply conduit 37 in the vapor phase when the system is operating in the cooling mode, as shown in FIG. 3, and in the liquid phase when the unit is operating in the heating mode as shown in FIG. 4. Pump 39 may be used in discharge conduit 38 in the cooling mode and pump 40 may be used in supply conduit 37 in the heating mode. These pumps may not be required depending upon the physical configurations and pressures in specific systems. Refrigerant is passed in heat exchange relation with the third thermal exchange medium or temperature control medium in third thermal exchanger 31. The term "heat exchange relation" as used throughout this description and claims is meant to include all modes of direct or indirect thermal exchange. Refrigerant is discharged from third thermal exchanger 31 through refrigerant discharge conduit 38 and is passed to the input of the second thermal exchanger such as direct expansion heat exchanger 18 of the compressor based refrigerant or unitary HVAC system. In the heating mode, the refrigerant passing through conduit 38 is in the vapor phase and in the cooling mode, the refrigerant passed through conduit 38 is in the liquid phase. In the cooling mode, remaining refrigerant vapor may be removed from third thermal exchanger 31 through refrigerant vapor discharge conduit 34, passed through pressure regulator 35 and refrigerant vapor conduit 36 to compressor 12 of the compressor based refrigerant system for passing sequentially through the first thermal exchanger 14 functioning as a condenser, refrigerant liquid conduit 15, throttling means 16 and refrigerant liquid conduit 17 to the second thermal exchanger 18 functioning as direct expansion heat exchange evaporator. It is seen that the added package of the present invention may be simply and economically retrofitted to a standard compressor based refrigerant system by simple conduit connections and simple electrical circuitry connections using control means known to the art.

The auxiliary thermal interfaced air conditioning system of this invention utilizes refrigerant liquid/vapor phase change and chilled media or warmed media from alternative external sources for operation in a cooling mode and heating mode, respectively. In the cooling mode, heat removal from the refrigerant through third thermal exchanger 31 may be by a chilled liquid loop, a vapor/liquid loop such as a heat pipe or thermo-syphon, or an externally cooled means such as an evaporator of another refrigerant cycle. In the heating mode with heat addition to the refrigerant, heat supply through third thermal exchanger 31 may be by direct heating such as an open flame, a warmed liquid loop, or a vapor/liquid loop such as a heat pipe or thermo-syphon. The source of thermal energy to provide supply or withdrawal of thermal energy by interface with the refrigerant may be furnished from any alternate energy source such as natural or substitute natural gas, cogeneration, waste heat of chemical processing, engine heat, and the like. The manner of and choice of source for supply or withdrawal of thermal energy by interface with the refrigerant of the compressor based refrigerant system depends upon availability of alternate thermal energy sources. The parallel capability provided by the interfacing as set forth by this invention, without redundant system costs, may be used with various bottoming cycles, such as in one embodiment, a standard unitary air conditioning package may be interfaced in the manner of this invention with an auxiliary source of refrigeration such as an engine driven generator or an engine driven refrigerant compressor using thermal energy rejected from the engine to power an absorption refrigeration system. This invention is applicable to refrigeration systems with evaporator temperatures substantially below 32° F. In the heating mode, the interfacing as set forth in the present invention may be used as a defrost cycle to a refrigeration system.

The combined apparatus of this invention is shown in schematic form in FIG. 3 for operation in the cooling mode. The second thermal exchanger 18 in the cooling mode, operates as a refrigerant evaporator and refrigerant vapor from second thermal exchanger 18 of the compressor based refrigerant system is supplied through refrigerant supply conduit 37 to third thermal exchanger 31 and passes in heat exchange relation to chilled third thermal exchange medium being introduced to third thermal exchanger 31 through the third thermal exchange medium supply conduit 32 at a temperature of below the temperature of the second thermal exchange medium after passing through second thermal exchanger 18, preferably below about 50° F. for residential and commercial space air conditioning, causing cooling and condensing all or at least a portion of the refrigerant vapor to refrigerant liquid. Chilled temperature control medium may be supplied at the desired temperature by any suitable method known to the art, such as by refrigeration. It is preferred that the chilled third thermal exchange medium be supplied to third thermal exchanger 31 at temperatures below about 10° to about 15° F. cooler than conditioned second thermal exchange medium 20 for operation of the apparatus and process of this invention in the cooling mode. The condensed refrigerant liquid may be passed through liquid pump 39 and refrigerant discharge conduit 38 to second thermal exchanger 18 of the compressor based refrigerant system. Refrigerant vapor which is not condensed to refrigerant liquid within third thermal exchanger 31 may be passed through refrigerant vapor discharge conduit 34, pressure regulator 35, and refrigerant vapor conduit 36 to refrigerant compressor 12 for condensation and completion of the cycle in the compressor based refrigerant system. The compressed refrigerant vapor is passed through refrigerant gas conduit 13 to first thermal exchanger 14 where it is condensed to refrigerant liquid, and conveyed through refrigerant liquid conduit 15 to throttling means 16, and through refrigerant liquid conduit 17 to second thermal exchanger 18. Thus, in the cooling mode, a first refrigerant loop may be provided comprising in sequence second thermal exchanger evaporator 18 and third thermal exchanger condenser 31 and a second refrigerant loop comprises in sequence second thermal exchanger evaporator 18, third thermal exchanger condenser 31, and first thermal exchanger condenser 14 of the compressor based refrigerant system. Thus, when the chilled third thermal exchange medium furnished to third thermal exchanger 31 is not sufficiently chilled to condense all of the refrigerant vapor, the vapor is passed through the first thermal exchanger, or refrigerant condenser, of the compressor based refrigerant system providing a dual loop system with the flow of the refrigerant through each of the loops being dependent in part upon the temperature of the chilled medium furnished. The dual refrigerant loop system provides complete backup for condensing of the refrigerant vapor in the combined system and-refrigerant flow may be controlled by means known to the art.

In the cooling mode when the compressor based refrigerant system compressor 12 operates concurrently with supply of chilled auxiliary thermal exchange medium to interfaced third thermal exchanger condenser 31, an evaporator pressure regulator controls the refrigerant vapor pressure within the third thermal exchanger to avoid depressing the saturation temperature below the temperature of the chilled third thermal exchange medium. The refrigerant vapor condenses in the interfaced third thermal exchanger condenser 31 to the extent there is capacity for heat to be transferred to the chilled third thermal exchange medium. In instances where cooling by the system is limited by the capacity of the second thermal exchanger evaporator 18, adequate refrigerant vapor will not be available to the refrigerant vapor compressor of the compressor based refrigerant system and the compressor may be disabled by a low suction pressure relay as known to the art.

FIG. 4 is a schematic diagram of the portion of the apparatus utilized in the heating mode according to the present invention. In the heating mode, warmed third thermal exchange medium may be supplied through supply conduit 32 to interfaced third thermal exchanger 31 functioning as a boiler or evaporator, the third thermal exchange medium discharging through discharge conduit 33. In the heating mode, refrigerant liquid is supplied through refrigerant supply conduit 37 by pump 40 from the second thermal exchanger 18 of the compressor based refrigerant system functioning as a condenser. The liquid refrigerant is vaporized by heat transfer with the warmed third thermal exchange medium passing through third thermal exchanger 31 which functions as an evaporator or boiler. The vaporized refrigerant is discharged from third thermal exchanger 31 through refrigerant discharge conduit 38 and passed directly to second thermal exchanger 18. In the heating mode, the remaining portions of the unitary compressor based refrigerant system may be disabled. This is accomplished by known means of electrical circuitry, similar to isolation and diverting valves, which are simple to install in the unitary compressor based refrigerant system. Warmed third thermal exchange medium may be supplied by any auxiliary means known to the art, such as from process heat, heat of cogeneration, and the like. The warmed third thermal exchange medium has a temperature sufficiently high to vaporize the liquid refrigerant used, generally above about 90° F., and preferably from about 110° to about 130° F.

It is seen from the above description that this invention has provided a thermal exchanger utilizing chilled/warmed media from an external source to advantageously interface with the refrigerant liquid/vapor phase change utilizing components of a standard unitary compressor based refrigerant system. The interfacing thermal exchanger may be retrofitted to existing unitary compressor based refrigerant systems by simple conduit connections and simple electrical switching wiring connections without major modification of the unitary compressor based refrigerant system itself. This invention provides utilization of alternate sources of thermal energy which may be selected depending upon economics and temperature relationships as desired. In the cooling mode, the apparatus of this invention provides a full backup system for condensation of vaporized refrigerant. Modification to components of the unitary compressor based refrigerant system itself, such as providing additional or new heat exchangers, increasing blower capacity, and the like, are totally eliminated by the easily retrofitted apparatus and process of the present invention.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. In an improved process for conditioning a second thermal exchange medium utilizing a compressor based refrigerant cycle wherein refrigerant vapor is compressed, the compressed refrigerant vapor is passed through a first thermal exchanger functioning as a condenser in thermal exchange relation to a first thermal exchange medium cooling and condensing said vapor to a liquid at relatively high temperature and pressure and warming said first thermal exchange medium, the liquid refrigerant is then passed through throttling means, and subsequently is passed through a second thermal exchanger functioning as an evaporator in thermal exchange relation to said second thermal exchange medium, said liquid refrigerant being warmed and vaporized at a relatively low temperature and pressure producing a cooling effect to said second thermal exchange medium, the improvement comprising:

passing said refrigerant vapor from said second thermal exchanger of said compressor based refrigerant cycle to a third thermal exchanger functioning as a condenser in thermal exchange relation to a third thermal exchange medium, said third thermal exchange medium supplied to said third thermal exchanger at a temperature to cause cooling and condensing at least a portion of said refrigerant vapor to refrigerant liquid; and passing said condensed refrigerant liquid to said second thermal exchanger.

2. The process of claim 1 wherein said third thermal exchange medium is supplied to said third thermal exchanger at a temperature below about 10° F. cooler than said second thermal exchange medium after passing through said second thermal exchanger.

3. The process of claim 1 wherein said third thermal exchange medium is supplied to said third thermal exchanger at a temperature below about 55° F.

4. In the improved process of claim 1 the additional step of:

passing any remaining refrigerant vapor from said third thermal exchanger for compression in said compressor based refrigerant cycle, condensing said refrigerant vapor in said first thermal exchanger of said compressor based refrigerant cycle to refrigerant liquid, and passing said condensed refrigerant liquid through said throttling means to said second thermal exchanger of said compressor based refrigerant cycle.

5. The process of claim 4 wherein said third thermal exchange medium is supplied to said third thermal exchanger at a temperature below about 10° F. cooler than said second thermal exchange medium after passing through said second thermal exchanger.

6. The process of claim 4 wherein said third thermal exchange medium is supplied to said third thermal exchanger at a temperature below about 55° F.

7. In an improved process for conditioning a second thermal exchange medium utilizing a compressor based refrigerant cycle of the type sequentially comprising in a refrigerant loop a refrigerant compressor, a first thermal exchanger condenser in thermal exchange relation to a first thermal exchange medium, a throttling means, and a second thermal exchanger in thermal exchange relation to said second thermal exchange medium, the improvement comprising:

passing refrigerant liquid from said second thermal exchanger of said compressor based refrigerant cycle to a third thermal exchanger functioning as an evaporator in thermal exchange relation to a third thermal exchange medium, said third thermal exchange medium supplied to said third thermal exchanger at a temperature to cause warming and evaporation of at least a substantial portion of said refrigerant liquid to a refrigerant vapor; and passing said refrigerant vapor to said second thermal exchanger functioning as a condenser in thermal exchange relation to said second thermal exchange medium cooling and condensing said vapor to a liquid warming said second thermal exchange medium, said compressor, said first thermal exchanger and said throttle being disabled.

8. The process of claim 7 wherein said third thermal exchange medium is supplied to said third thermal exchanger at a temperature above about 90° F.

9. In an apparatus for conditioning a second thermal exchange medium, said apparatus comprising in conduit communication and in sequence in a refrigerant loop, a compressor, a first thermal exchanger condenser in thermal exchange relation to a first thermal exchange medium provided from external to said loop, a throttling means, and a second thermal exchanger in thermal exchange relation to said second thermal exchange medium provided from external to said loop, the improvement comprising:

a third thermal exchanger in thermal exchange relation to a third thermal exchange medium provided from external to said loop, first conduit means capable of passing said refrigerant from an outlet of said second thermal exchanger to the inlet of said third thermal exchanger, second conduit means capable of passing said refrigerant from an outlet of said third thermal exchanger to an inlet of said second thermal exchagner, and third conduit means capable of passing refrigerant vapor from a vapor outlet of said third thermal exchanger to an inlet of said compressor.

10. The apparatus of claim 9 additionally comprising pump means in said first conduit means.

11. The apparatus of claim 9 additionally comprising pump means in said second conduit means.

12. The apparatus of claim 9 additionally comprising pressure release means in said third conduit means.

13. The apparatus of claim 9 additionally comprising chilling means capable of chilling said third thermal exchange medium for passage in thermal exchange relation to said third thermal exchanger.

14. The apparatus of claim 13 wherein said chilling means is capable of chilling said third thermal exchange medium to a temperature below about 10° F. cooler than said second thermal exchange medium after passing said second thermal exchanger.

15. The apparatus of claim 13 wherein said chilling means is capable of chilling said third thermal exchange medium to a temperature below about 55° F.

16. The apparatus of claim 9 additionally comprising heating means capable of warming said third thermal exchange medium for passage in thermal exchange relation to said third thermal exchanger.

17. The apparatus of claim 16 wherein said heating means is capable of warming said third thermal exchange medium to a temperature above about 90° F.

18. The apparatus of claim 9 additionally comprising disabling means capable of inactivating refrigerant flow from said third thermal exchanger to said compressor and refrigerant flow from said throttling means to said second thermal exchanger, thereby inactivating said compressor, said first thermal exchanger, and said throttling means.

* * * * *